US010234790B2

(12) United States Patent
Yoshii

(10) Patent No.: US 10,234,790 B2
(45) Date of Patent: Mar. 19, 2019

(54) TONER CASE INCLUDING INTERNAL SHUTTER MEMBER, TONER SUPPLY DEVICE, AND IMAGE FORMING APPARATUS

(71) Applicant: KYOCERA Document Solutions Inc., Osaka-shi, Osaka (JP)

(72) Inventor: Tatsuhiko Yoshii, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/912,093

(22) Filed: Mar. 5, 2018

(65) Prior Publication Data

US 2018/0259880 A1 Sep. 13, 2018

(30) Foreign Application Priority Data

Mar. 10, 2017 (JP) ..... 2017-045791

(51) Int. Cl.
*G03G 15/08* (2006.01)
*G03G 15/18* (2006.01)

(52) U.S. Cl.
CPC ..... *G03G 15/0867* (2013.01); *G03G 15/0886* (2013.01); *G03G 15/18* (2013.01); *G03G 15/0868* (2013.01)

(58) Field of Classification Search
CPC ..... G03G 15/0834; G03G 15/0837; G03G 15/0877; G03G 15/0886
See application file for complete search history.

(56) References Cited

U.S. PATENT DOCUMENTS

2012/0076548 A1* 3/2012 Ninomiya ..... G03G 15/0875 399/262
2013/0322927 A1* 12/2013 Matsumoto ..... G03G 15/0839 399/258

FOREIGN PATENT DOCUMENTS

JP 2006065112 A 3/2006

* cited by examiner

*Primary Examiner* — Walter L Lindsay, Jr.
*Assistant Examiner* — Arlene Heredia
(74) *Attorney, Agent, or Firm* — Alleman Hall Creasman & Tuttle LLP

(57) ABSTRACT

A toner case includes a toner storage portion, a cylindrical portion, a shutter member, and a biasing member. The cylindrical portion has an interior space and communicated with the interior of the toner storage portion through a toner discharge port. An opening is formed at one of opposite ends of the interior space, and a closing wall is formed at the other of the opposite ends of the interior space. The shutter member is supported so as to be slidable in an extension direction of the cylindrical portion, and is movable between a closing position and an opening position. The shutter member at the closing position closes the toner discharge port, and the shutter member at the opening position opens the toner discharge port. The biasing member configured to position the shutter member to the closing position by applying a biasing force to the shutter member.

7 Claims, 8 Drawing Sheets

TONER CASE INCLUDING INTERNAL SHUTTER MEMBER, TONER SUPPLY DEVICE, AND IMAGE FORMING APPARATUS

INCORPORATION BY REFERENCE

This application is based upon and claims the benefit of priority from the corresponding Japanese Patent Application No. 2017-045791 filed on Mar. 10, 2017, the entire contents of which are incorporated herein by reference.

BACKGROUND

The present disclosure relates to: a toner case including a storage portion configured to store toner; a toner supply device configured to be coupled with the toner case and supply toner from the toner case to a developing device; and an image forming apparatus.

There is known an image forming apparatus for forming an image on a paper sheet by using toner. This type of image forming apparatus is provided with a toner case (toner container) which stores toner to be supplied to a developing device that is provided in the interior of the image forming apparatus. The toner case is provided in an apparatus main body of the image forming apparatus in a detachable manner. As the toner in the developing device is consumed, the toner is supplied from the toner case. When the toner case becomes empty of toner, the toner case is removed from the image forming apparatus, and the toner case is replaced with a new one storing unused toner.

In general, the toner case has a discharge port through which the toner is discharged. The toner case also includes a shutter member for closing the discharge port. In conventional toner cases, there is known a plate-like shutter member of a slide opening/closing type.

SUMMARY

A toner case according to an aspect of the present disclosure includes a toner storage portion, a cylindrical portion, a shutter member, and a biasing member. The toner storage portion is configured to store toner in its interior and has a toner discharge port formed in its bottom surface. The cylindrical portion is in a cylindrical shape, has an interior space extending in a horizontal direction and communicated with the interior of the toner storage portion through the toner discharge port. An opening is formed at one of opposite ends of the interior space, and a closing wall is formed at the other of the opposite ends of the interior space. The shutter member is provided in the interior space and supported so as to be slidable in an extension direction of the cylindrical portion, against inner wall surfaces of the cylindrical portion forming the interior space. The shutter member is movable between a closing position and an opening position. The shutter member at the closing position comes in close contact with a peripheral edge of the toner discharge port and closes the toner discharge port. The opening position is separated from the closing position toward the closing wall. The shutter member at the opening position opens the toner discharge port. The biasing member is provided in the interior space between the shutter member and the closing wall and configured to position the shutter member to the closing position by applying a biasing force to the shutter member.

A toner supply device according to another aspect of the present disclosure is configured to be coupled with a toner case having a downward toner discharge port such that toner is supplied from the toner discharge port to a developing device. The toner supply device includes a cylindrical portion, a shutter member, a biasing member, and a toner conveyance guide portion. The cylindrical portion is in a cylindrical shape and provided in the toner case. The cylindrical portion has an interior space extending in a horizontal direction and communicated with the interior of the toner storage portion through the toner discharge port. An opening is formed at one of opposite ends of the interior space, and a closing wall is formed at the other of the opposite ends of the interior space. The shutter member is provided in the interior space and supported so as to be slidable in an extension direction of the cylindrical portion, against inner wall surfaces of the cylindrical portion forming the interior space. The shutter member is movable between a closing position and an opening position. The shutter member at the closing position comes in close contact with a peripheral edge of the toner discharge port and closes the toner discharge port. The opening position is separated from the closing position toward the closing wall. The shutter member at the opening position opens the toner discharge port. The biasing member is provided in the interior space between the shutter member and the closing wall and configured to position the shutter member to the closing position by applying a biasing force to the shutter member. The toner conveyance guide portion is in a cylindrical shape, provided in the developing device, and projects from a side wall of the developing device in the horizontal direction. A toner replenishment port is formed in an upper surface of a projection end portion of the toner conveyance guide portion. When the toner case is coupled with the developing device so that the projection end portion of the toner conveyance guide portion is inserted in the opening, the shutter member receives a pressing force from the projection end portion and moves from the closing position to the opening position, and the toner conveyance guide portion relatively moves to a position such that the toner replenishment port is disposed below the toner discharge port.

An image forming apparatus according to a further aspect of the present disclosure includes a developing device and a toner case. The developing device is provided in an apparatus main body. The toner case has a downward toner discharge port and is configured to be coupled with the developing device such that toner is supplied from the toner discharge port to the developing device. The toner case includes a toner storage portion, a cylindrical portion, a shutter member, and a biasing member. The toner storage portion is configured to store the toner in its interior and has the toner discharge port formed in its bottom surface. The cylindrical portion is in a cylindrical shape and has an interior space extending in a horizontal direction and communicated with the interior of the toner storage portion through the toner discharge port. An opening is formed at one of opposite ends of the interior space, and a closing wall is formed at the other of the opposite ends of the interior space. The shutter member is provided in the interior space and supported so as to be slidable in an extension direction of the cylindrical portion, against inner wall surfaces of the cylindrical portion forming the interior space. The shutter member is movable between a closing position and an opening position. The shutter member at the closing position comes in close contact with a peripheral edge of the toner discharge port and closes the toner discharge port. The opening position is separated from the closing position toward the closing wall. The shutter member at the opening position opening the toner discharge port. The biasing member is provided in the interior space between the shutter member and the closing wall and configured to position the shutter member to the closing position by applying a biasing force to the shutter member. The developing device includes a toner conveyance guide portion. The toner conveyance guide portion is in a cylindrical shape and projects from a side wall of the developing device in the horizontal direction. A toner replenishment port is formed in an upper surface of a projection end portion of the toner conveyance guide portion. When the toner case is coupled with the developing device so that the projection end portion of the toner conveyance guide portion is inserted in the opening, the shutter member receives a pressing force from the projection end portion and moves from the closing position to the opening position, and the toner conveyance guide portion relatively moves to a position such that the toner replenishment port is disposed below the toner discharge port.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
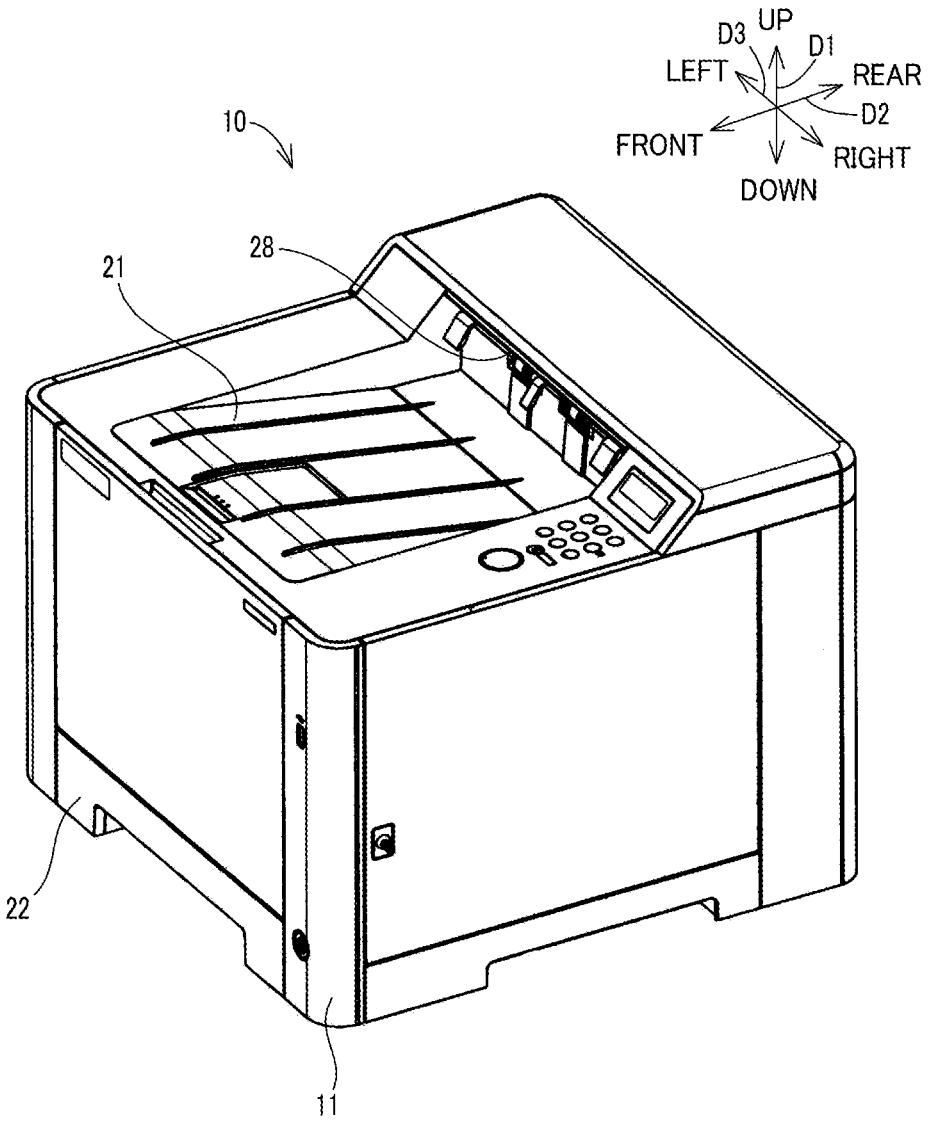
FIG. 1 is a perspective view of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure. It is noted that for convenience of explanation, a vertical direction in a state where the image forming apparatus 10 is installed in a usable manner (the state shown in FIG. 1) is defined as an up-down direction D1. In addition, a front-rear direction D2 is defined on the supposition that a surface to/from which a sheet feed cassette 22 shown in FIG. 1 is inserted or pulled out in the installed state is a front surface of the image forming apparatus 10. In addition, a left-right direction D3 is defined based on the front surface of the image forming apparatus 10 in the installed state.

The image forming apparatus 10 according to the embodiment of the present disclosure has at least a print function. The image forming apparatus 10 is, for example, a tandem-type color printer.

Figure 2:
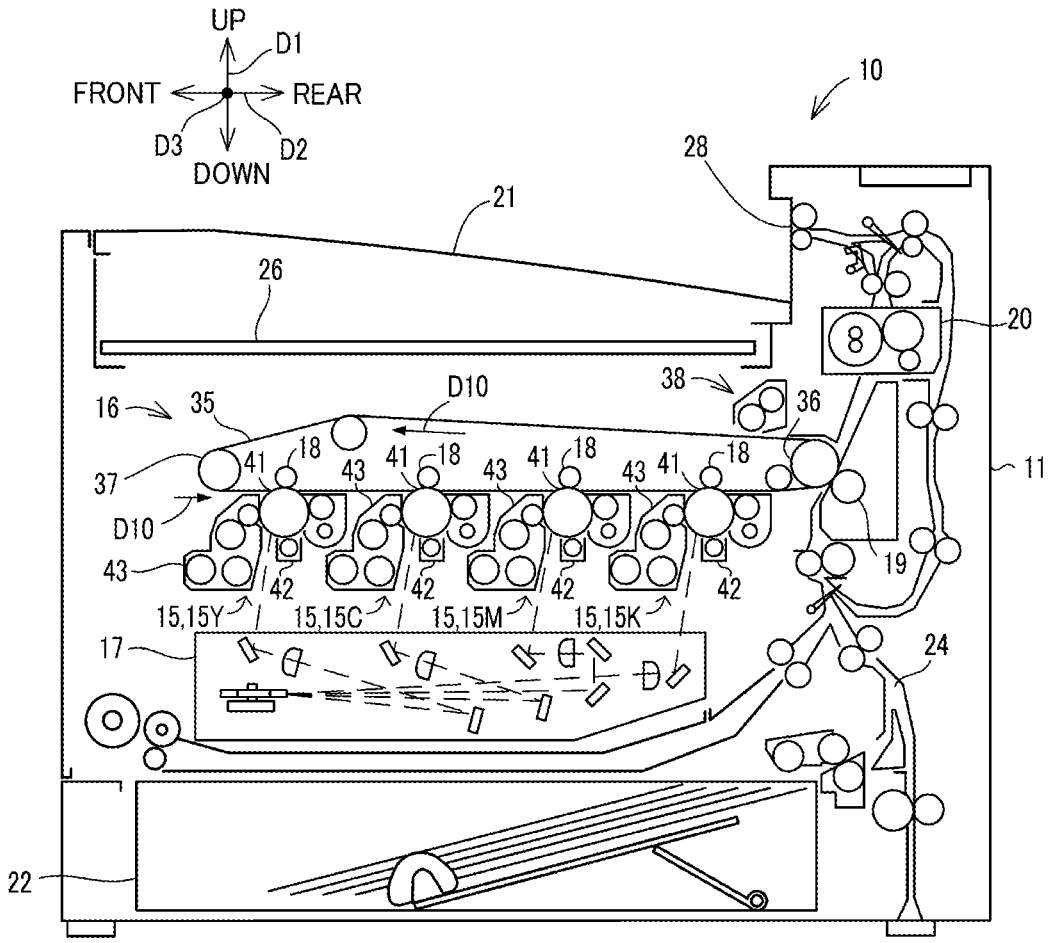
FIG. 2 is a cross-sectional view showing a configuration of the image forming apparatus.

As shown in FIG. 1 and FIG. 2, the image forming apparatus 10 includes a casing 11 (an example of the apparatus main body). The casing 11 is in the shape of rectangular parallelepiped as a whole. The casing 11 stores components of the image forming apparatus 10.

As shown in FIG. 2, the image forming apparatus 10 includes a plurality of image forming units 15 (15Y, 15C, 15M, and 15K), an intermediate transfer unit 16, a laser scanning device 17, a primary transfer roller 18, a secondary transfer roller 19, a fixing device 20, a sheet tray 21, the sheet feed cassette 22, a conveyance path 24, and a control board 26 configured to control the portions of the image forming apparatus 10. In addition, the image forming apparatus 10 includes toner containers 3 (an example of the toner case of the present disclosure; see FIG. 1) that are attached to the inside of the casing 11 in a detachable manner. In the present embodiment, the image forming apparatus 10 includes four image forming units 15.

As shown in FIG. 2, the intermediate transfer unit 16 is provided above the four image forming units 15. The intermediate transfer unit 16 includes a transfer belt 35, a driving roller 36, a driven roller 37, and a belt cleaning device 38. It is noted that the primary transfer roller 18 is supported by a frame (not shown) of the intermediate transfer unit 16.

The transfer belt 35, an annular belt member, is suspended between the driving roller 36 and the driven roller 37 so as to extend in the front-rear direction D2. The transfer belt 35 holds, on its surface, toner images primarily transferred from the photoconductor drums 41. When the transfer belt 35 is rotationally driven and moves in a direction indicated by the arrow D10, the toner images of respective colors carried by the photoconductor drums 41 are transferred to the transfer belt 35 such that the toner images are overlaid with each other in sequence on the transfer belt 35.

The image forming units 15 form toner images based on an electrophotographic system. Each of the image forming units 15 includes a photoconductor drum 41, a charging device 42, and a developing device 43. That is, the image forming apparatus 10 includes four developing devices 43.

As shown in FIG. 2, the four image forming units 15 are arranged in alignment along the front-rear direction D2 in the casing 11. A color image is formed by the four image forming units 15. Specifically, the image forming unit 15Y forms a yellow toner image. In addition, the image forming units 15C, 15M and 15K form cyan, magenta, and black toner images, respectively. In order from the downstream side (front side) in a direction in which the transfer belt 35 of the intermediate transfer unit 16 moves (the direction indicated by the arrow D10), the image forming unit 15Y for yellow, the image forming unit 15C for cyan, the image forming unit 15M for magenta, and the image forming unit 15K for black are arranged in alignment.

The photoconductor drum 41 has a cylindrical shape elongated in the left-right direction D3, and carries a toner image developed by the developing device 43. The photoconductor drum 41 is rotatably supported in the housing 31.

In each of the image forming units 15, the charging device 42 uniformly charges the photoconductor drum 41 to a certain potential. Subsequently, the laser scanning device 17 irradiates a laser beam on the surface of the photoconductor drum 41 based on the image data. In this processing, electrostatic latent images are formed on the surfaces of the photoconductor drums 41, respectively. The electrostatic latent images are developed (visualized) as toner images by the developing devices 43, respectively. The toner images of respective colors formed on the surfaces of the photoconductor drums 41 are transferred to the transfer belt 35 by the primary transfer roller 18 such that the toner images are overlaid with each other in sequence. Next, the color image on the transfer belt 35 is transferred by the secondary transfer roller 19 to a print sheet. The color image transferred to the print sheet is fixed to the print sheet by the fixing device 20, and thereafter, the print sheet is discharged from a sheet discharge port 28 to the sheet tray 21.

Figure 3:
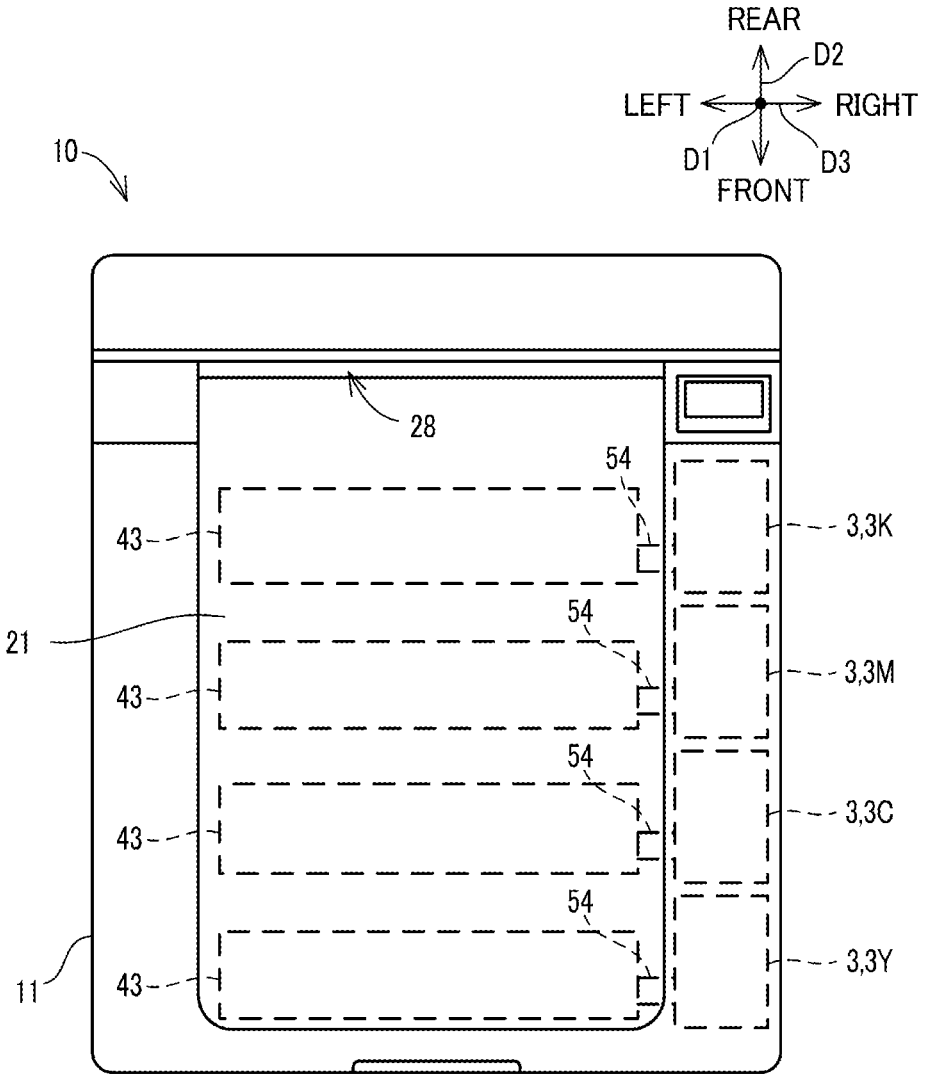
FIG. 3 is a plan view showing an arrangement of toner containers and developing devices in the image forming apparatus.

As shown in FIG. 3, the four developing devices 43 are arranged in parallel in the casing 11 along the front-rear direction D2. The four developing devices 43 have the same shape and configuration. Four support frames 11A (see FIG. 4) for supporting the developing devices 43 are attached to the interior of the casing 11, and the developing devices 43 are supported by the support frames 11A. In addition, four toner containers 3 are respectively disposed on the left side adjacent to the four developing devices 43. Four support frames 11B (see FIG. 4) for supporting the toner containers 3 are attached to the interior of the casing 11, and the toner containers 3 are supported by the corresponding support frames 11B in a detachable manner.

Figure 4:
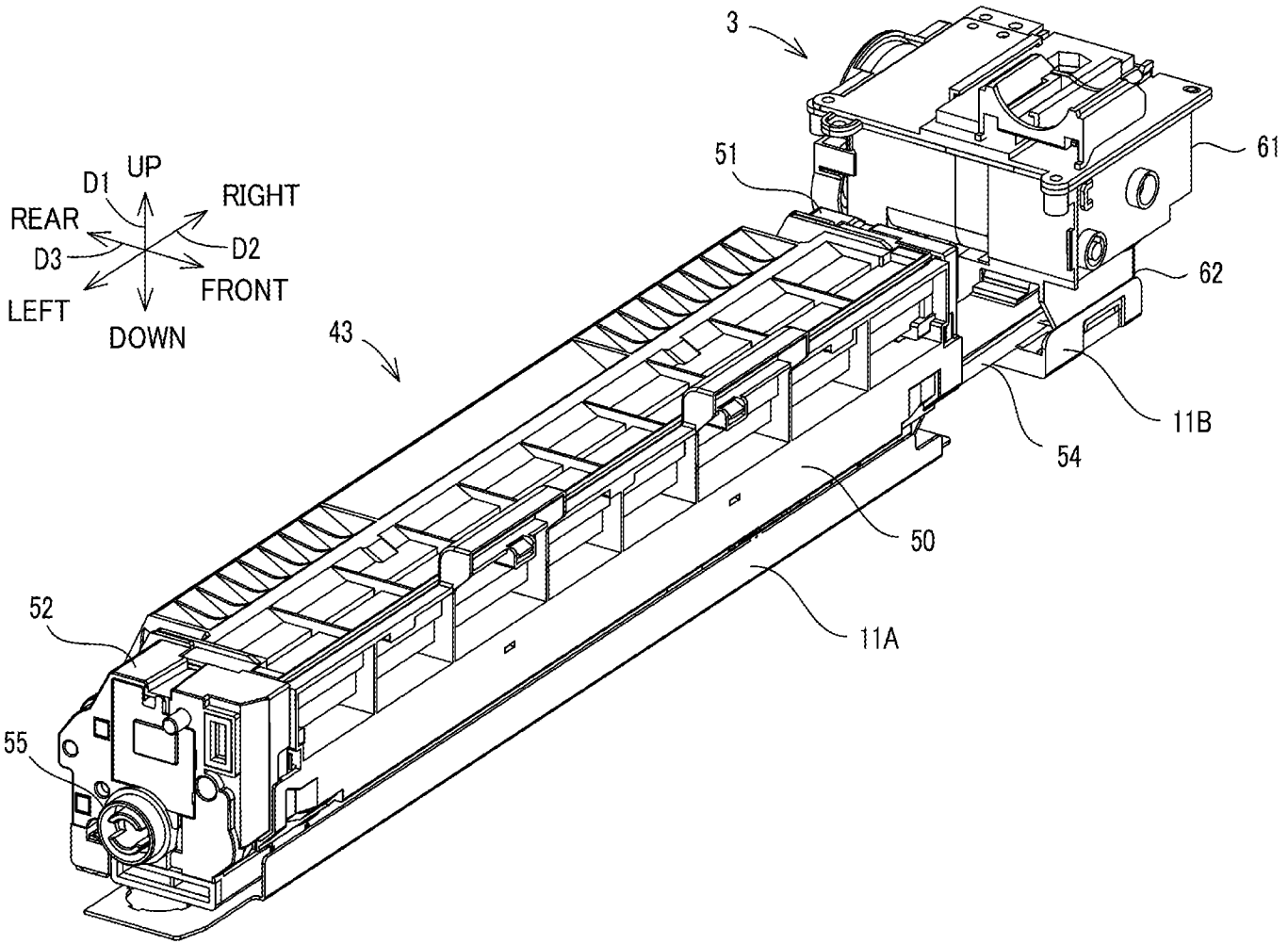
FIG. 4 is a perspective view showing a toner container and a developing device.
Figure 5:
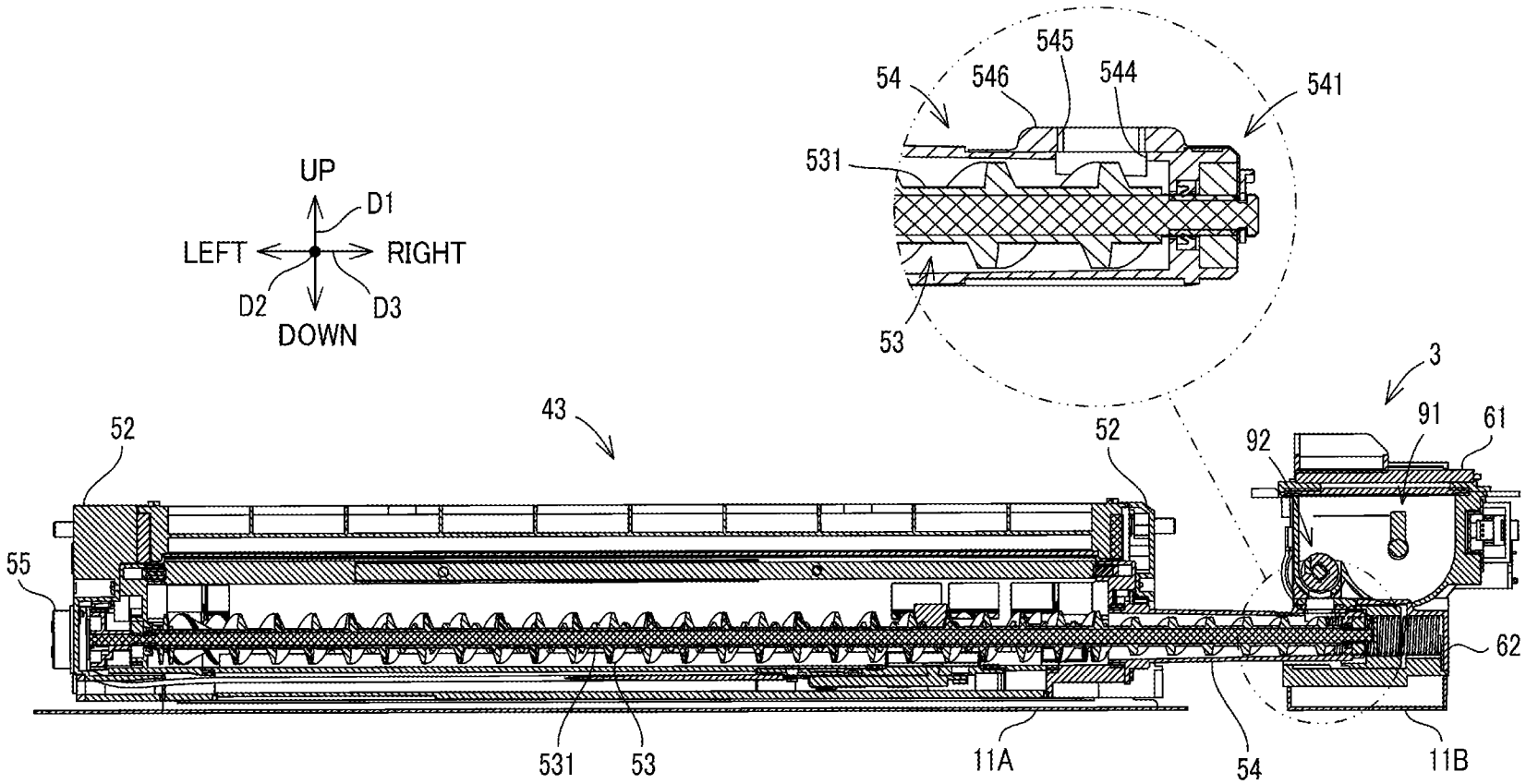
FIG. 5 is a cross-sectional view showing an internal configuration of the toner container and the developing device.

As shown in FIG. 4 and FIG. 5, the developing device 43 includes a housing 50. The housing 50 is formed in an approximate shape of rectangular parallelepiped elongated in the left-right direction D3. Toner (developer) is stored in a bottom portion of the interior of the housing 50. In addition, a conveyance member 53 (see FIG. 5) and a developing roller (not shown) are provided in the interior of the housing 50, wherein the conveyance member 53 is configured to convey, while stirring, the toner along the longitudinal direction of the housing 50 (the left-right direction D3), and the developing roller holds the stirred toner on its outer circumferential surface. The conveyance member 53 is formed by putting a spiral blade to an outer circumferential surface of a rotation shaft member that is elongated in the left-right direction D3. By being rotated upon receiving a driving force from outside, the conveyance member 53 conveys toner replenished from a replenishment port 544 (an example of the toner replenishment port of the present disclosure) which is described below, to the interior of the developing device 43. The developing roller draws up the toner that has been stirred by the conveyance member 53, by a magnet embedded therein, and carries the toner on its outer circumferential surface. The toner carried on the developing roller is adhered to the electrostatic latent image on the photoconductor drum 41 by the potential difference applied to between the developing roller and the photoconductor drum 41.

A toner conveyance guide 54 is provided on a side wall 51 (right-side wall) of the housing 50, namely, a side wall of the housing 50 at one end (the right end) in the longitudinal direction thereof, wherein the toner conveyance guide 54 (an example of the toner conveyance guide portion of the present disclosure) projects outward (rightward) from the driving roller 51. The toner conveyance guide 54 projects from the driving roller 51 in the horizontal direction. The toner conveyance guide 54 is a cylindrical member whose interior is hollow.

As shown in a partially enlarged view (a portion encircled by a two-dot chain line) in FIG. 5, a tip end portion 541 (a projection end portion) of the toner conveyance guide 54 is closed. On the other hand, a base end portion 542 (an end portion on the side wall 51 side) of the toner conveyance guide 54 is communicated with the interior of the housing 50. The conveyance member 53 is supported so as to be rotatable while inserted in the interior of the toner conveyance guide 54. Specifically, a shaft hole is formed in the tip end portion 541. The shaft hole rotatably supports an end portion of a rotation shaft 531 of the conveyance member 53. The rotation shaft 531 is inserted in the shaft hole via a sliding member such as a bushing ring, and an end portion of the rotation shaft 531 projects outward from the tip end portion 541. In addition, a shaft hole is formed in a side wall 52 (left-side wall) of the housing 50, namely, a side wall at the other end (the left end) of the housing 50 in the longitudinal direction. The shaft hole rotatably supports the other end portion of the rotation shaft 531 of the conveyance member 53. In this way, the conveyance member 53 is rotatably supported by the shaft holes that are respectively formed in the tip end portion 541 and the side wall 52.

In the present embodiment, the upper part of the toner conveyance guide 54 is formed in the shape of flat plate, and the lower part is formed in the shape of arc corresponding to the shape of the conveyance member 53.

It is noted that as shown in FIG. 4, a shaft coupling 55 is provided on the side wall 52 of the housing 50, wherein the shaft coupling 55 is coupled with the rotation shaft 531. The conveyance member 53 is rotationally driven when a rotational driving force is transmitted to the shaft coupling 55 from a drive transmission mechanism (not shown).

As shown in FIG. 5, a replenishment port 544 is formed on the upper surface of the toner conveyance guide 54. The replenishment port 544 is formed on the upper surface of the toner conveyance guide 54 at a position on the tip end side. The replenishment port 544 is configured to receive the toner discharged from a toner discharge port 617 (see FIG. 6) of the toner container 3 in a state where the toner container 3 is attached to the image forming apparatus 10. That is, the toner discharged from the toner container 3 is replenished to the interior of the housing 50 via the replenishment port 544. A seal member 546 is adhered to the outer peripheral edge of the replenishment port 544, wherein the seal member 546 has a through hole 545 that is communicated with the replenishment port 544. The seal member 546 is formed from, for example, a resin member such as an elastic, flexible urethane foam. When the tip end portion 541 of the toner conveyance guide 54 is inserted in a coupling portion 62 of the toner container, the seal member 546 comes in close contact with a seal member 65 of the coupling portion 62, thereby preventing toner leakage.

As shown in FIG. 3, a plurality of toner containers 3 (3Y, 3C, 3M and 3K) are attached to the interior of the housing 11. Specifically, the four toner containers 3 are respectively disposed on the left side adjacent to the four developing devices 43. The four toner containers 3 are formed to have the same shape.

The following describes the toner containers 3 in detail with reference to FIG. 6 to FIG. 8C. It is noted that in FIG. 6 to FIG. 8C, the up-down direction D1, the front-rear direction D2, and the left-right direction D3 are indicated based on the attachment attitude of the toner containers 3 attached to the support frames 11B. In the following, the up-down direction D1 may be called a height direction D1 of the toner container 3, the front-rear direction D2 may be called a width direction D2 of the toner container 3, and the left-right direction D3 may be called a depth direction D3 of the toner container 3.

Figure 6:
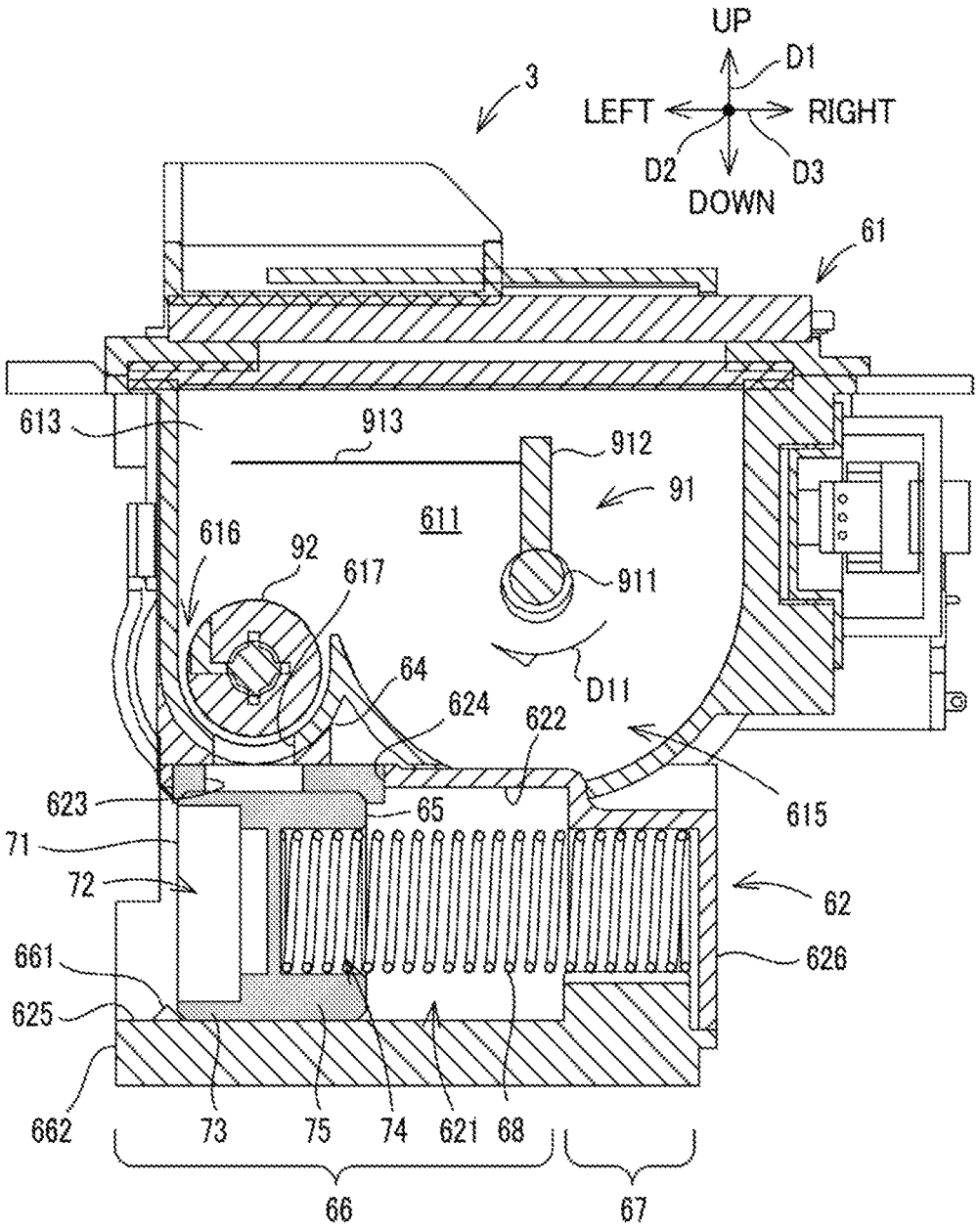
FIG. 6 is a cross-sectional view showing an internal configuration of the toner container.

As shown in FIG. 6, each of the toner containers 3 includes a toner storage portion 61 and a coupling portion 62 (an example of the cylindrical portion of the present disclosure), wherein the toner storage portion 61 is provided in an upper part of the toner storage portion 61, and the coupling portion 62 is provided below the toner storage portion 61. The toner storage portion 61 has a storage space 611 in the interior thereof, and unused toner for replenishment is stored in the storage space 611. The toner storage portion 61 and the coupling portion 62 of the toner container 3 are resin molded articles that are generated by injection-molding synthetic resin, and the toner storage portion 61 and the coupling portion 62 are integrally formed. These portions are formed from, for example, ABS resin that is highly versatile and inexpensive. In a state where a toner container 3 is attached to a support frame 11B, the unused toner is replenished from the toner storage portion 61 of the toner container 3 to the interior of the developing device 43.

The size of the toner storage portion 61 in the width direction D2 is approximately the same as the width of the developing device 43. In addition, the size of the toner storage portion 61 in the depth direction D3 is slightly smaller than the size in the width direction D2. Furthermore, the size of the toner storage portion 61 in the height direction D1 is smaller than the size in the depth direction D3, and is relatively shallow.

A stirring member 91 is provided in the interior of the toner storage portion 61, wherein the stirring member 91 is a rotation member extending in the width direction D2. Specifically, the stirring member 91 is paddle-like, and is provided in the storage space 611. The stirring member 91 is supported by side walls 613 of the toner storage portion 61 at opposite ends thereof in the width direction D2, so as to be rotatable in the storage space 611.

Upon receiving a driving force from outside, the stirring member 91 rotates in a rotation direction indicated by the arrow D11 shown in FIG. 6. This allows the unused toner stored in the toner storage portion 61 to be stirred. The stirring member 91 is provided in parallel to a conveyance member 92 that is described below. The stirring member 91 includes a rotation shaft 911, an arm portion 912, and a paddle portion 913, wherein the arm portion 912 projects from the rotation shaft 911 in a direction vertical to the shaft, and the paddle portion 913 is a film-like member attached to a tip end of the arm portion 912. The paddle portion 913 is formed from, for example, an elastic synthetic resin material such as polyester or PET (polyethylene terephthalate) resin.

The toner storage portion 61 includes a first storage portion 615 and a second storage portion 616, wherein each of the first storage portion 615 and the second storage portion 616 has an arc-shaped bottom surface. The first storage portion 615 is formed on the right side in the toner storage portion 61, and extends in the width direction D2. The second storage portion 616 is formed on the left side of the first storage portion 615 continuing to the first storage portion 615, and extends in the width direction D2. The bottom surface of the first storage portion 615 is larger than the bottom surface of the second storage portion 616 in radius of the arc.

In the present embodiment, the stirring member 91 is provided in the toner storage portion 61 such that the rotation shaft 911 is disposed at the center of the arc shape of the bottom surface of the first storage portion 615. As a result, when the stirring member 91 is rotated, the paddle portion 913 slides while in contact with the arc-shaped bottom surface of the first storage portion 615, and scoops up the toner from the first storage portion 615 into the second storage portion 616.

The second storage portion 616 includes the conveyance member 92 for conveying the toner to the developing device 43. The conveyance member 92 is a rotation member extending in the width direction D2, and is rotatably provided in the second storage portion 616. The conveyance member 92 includes a rotation shaft member extending in the width direction D2, and a spiral blade attached to the outer circumferential surface of the rotation shaft member. Upon receiving a driving force from outside, the conveyance member 92 rotates, and thereby conveys the toner in the second storage portion 616 along the extension direction of the second storage portion 616 toward the toner discharge port 617 that is described below.

The toner discharge port 617 is formed in the bottom surface of the toner storage portion 61 so that the toner stored in the storage space 611 can be discharged to outside. Specifically, the toner discharge port 617 is formed in the bottom surface of the second storage portion 616. The toner discharge port 617 is a through opening opened downward. Specifically, the toner discharge port 617 is a through opening formed to pierce through an arc-shaped bottom wall 64 constituting the bottom surface of the second storage portion 616, downward in the vertical direction. The toner discharge port 617 is formed in a front end portion of the bottom wall 64 of the second storage portion 616. The toner discharge port 617 is approximately square.

The coupling portion 62 is provided below the toner storage portion 61. The coupling portion 62 is a cylindrical member extending horizontally along the depth direction D3. An interior space 621 of the coupling portion 62 extends in the depth direction D3 that is perpendicular to a direction in which the stirring member 91 and the conveyance member 92 extend, and extends in the same direction in which the conveyance member 53 of the developing device 43 extends. In the present embodiment, the coupling portion 62 is formed in the shape of square tube which is rectangular in a cross section perpendicular to the extension direction of the coupling portion 62. That is, the interior space 621 is a hollow which extends in the depth direction D3 and is rectangular in a cross section.

The interior space 621 is communicated with the storage space 611 of the toner storage portion 61 via the toner discharge port 617. Specifically, a communication port 623 communicated with the toner discharge port 617 is formed in an upper wall part 622 which is one of a plurality of outer circumferential walls of the coupling portion 62. The communication port 623 is formed in the upper wall part 622 in the vicinity of a left end portion thereof. The interior space 621 communicates with the storage space 611 through the communication port 623, the toner discharge port 617, and the second storage portion 616.

The seal member 65 is attached to the upper wall part 622. Specifically, an opening portion 624 is formed in the upper wall part 622, and the seal member 65 is fitted in at the peripheral edge of the opening portion 624, wherein the opening portion 624 is larger than the toner discharge port 617 in diameter. The seal member 65 is formed from, for example, a resin member such as an elastic, flexible urethane foam. The seal member 65 is, in a state of not receiving an external force, protruding from the upper wall part 622 toward the interior space 621. The communication port 623 is formed at the center of the seal member 65, and in a state where the seal member 65 is attached to the opening portion 624, the communication port 623 is communicated with the toner discharge port 617.

The coupling portion 62 includes an opening 625 at one of opposite end portions (a left end portion) of the interior space 621. In addition, the coupling portion 62 includes a closing wall 626 at the other of the opposite end portions (a right end portion) of the interior space 621. The opening 625 opens the left side of the interior space 621, and the closing wall 626 closes the right side of the interior space 621.

The coupling portion 62 includes a large-diameter cylindrical portion 66 and a small-diameter cylindrical portion 67 that divide the interior space 621 in two in the extension direction of the coupling portion 62. The large-diameter cylindrical portion 66 is formed in a left part of the coupling portion 62, and the small-diameter cylindrical portion 67 is formed between the large-diameter cylindrical portion 66 and the closing wall 626. The large-diameter cylindrical portion 66 is larger than the small-diameter cylindrical portion 67 in inner diameter. In addition, the large-diameter cylindrical portion 66 is larger than the small-diameter cylindrical portion 67 in size in the depth direction D3.

Meanwhile, a conventional toner container has the following problem. That is, since it is configured to open and close a toner discharge port by a plate-like shutter member of a slide opening/closing type, if a clearance of a slide mechanism of a shutter member (a gap between a slide rail and a guide) is widened to realize a smooth opening/closing of the shutter member, a toner leakage occurs due to rattling of the shutter member. On the other hand, if the clearance is narrowed, the toner leakage is reduced, but the shutter member is not opened or closed smoothly. In view of this problem, in the present embodiment, each of the toner containers 3 includes the toner storage portion 61 and the coupling portion 62 configured as described above, as well as a shutter member 71 and a coil spring 68 that are described below.

Each of the toner containers 3 further includes the shutter member 71 and the coil spring 68 (an example of the biasing member of the present disclosure). The shutter member 71 is an opening/closing member for opening and closing the toner discharge port 617, and is provided in the interior space 621 of the coupling portion 62. The coil spring 68 applies a biasing force to the shutter member 71, and is provided in the interior space 621.

The shutter member 71 is supported so as to be movable between an opening position and a closing position in the interior of the large-diameter cylindrical portion 66. The closing position is a position shown in FIG. 6, and at the closing position, the shutter member 71 comes in close contact with the peripheral edge of the communication port 623, and closes the communication port 623 and the toner discharge port 617. In addition, the opening position is a position (a position shown in FIG. 8C) separated from the closing position toward the closing wall 626, and at the opening position, the shutter member 71 opens the communication port 623.

Figure 7:
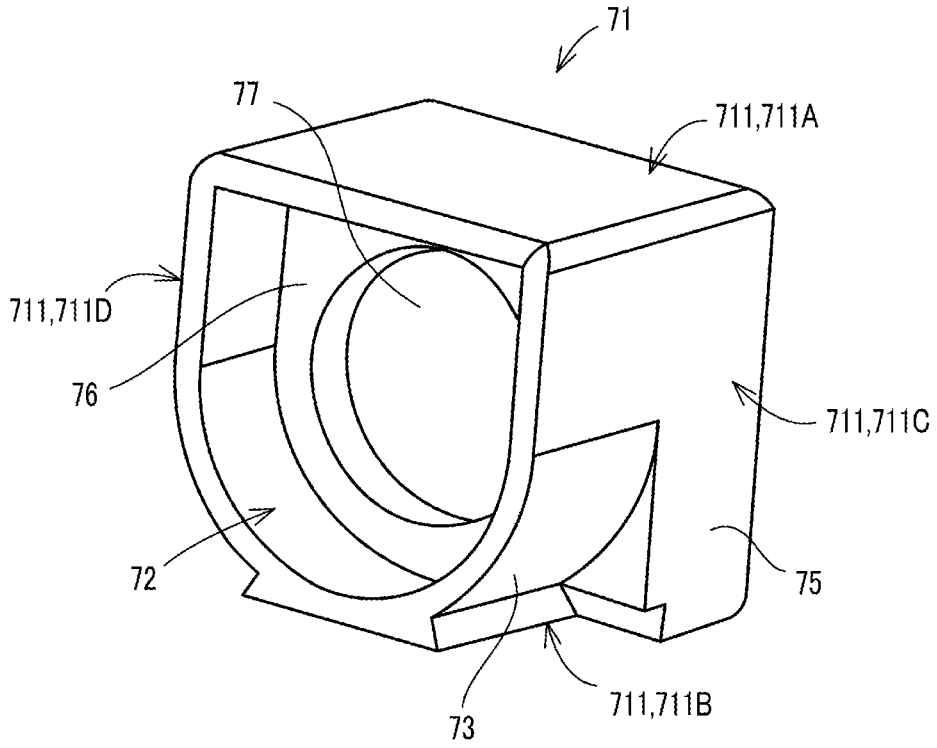
FIG. 7 is a perspective view of a shutter member for opening and closing a toner discharge port of the toner container.

As shown in FIG. 7, the shutter member 71 is a block-like member (block member) that is formed in the shape of rectangle in a cross section in correspondence with the shape of the interior of the large-diameter cylindrical portion 66 of the coupling portion 62. The shutter member 71 is a resin molded article that is generated by injection-molding synthetic resin, and is formed from, for example, polyacetal resin whose sliding resistance is smaller than that of the coupling portion 62. In the present embodiment, the shutter member 71 is provided in the interior of the large-diameter cylindrical portion 66 in a state where four outer wall surfaces 711 (an upper surface 711A, a lower surface 711B, a side surface 711C, and a side surface 711D) of the shutter member 71 are in sliding contact with all of four inner wall surfaces forming the interior of the large-diameter cylindrical portion 66 that are elongated in the depth direction D3. This allows the shutter member 71 to be supported so as to be slidable in the interior of the large-diameter cylindrical portion 66 along the depth direction D3.

The shutter member 71, in the state of being provided in the interior of the large-diameter cylindrical portion 66, includes a receiving portion 73 (an example of the first part of the present disclosure) and a spring seat 75 (an example of the second part of the present disclosure), wherein the receiving portion 73 includes a recessed portion 72 (an example of the first recessed portion of the present disclosure) formed on a side surface of the shutter member 71 on the opening 625 side, and the spring seat 75 includes a recessed portion 74 (an example of the second recessed portion of the present disclosure) formed on a side surface of the shutter member 71 on the closing wall 626 side. In addition, the shutter member 71 includes a partition wall 76 that divides the receiving portion 73 from the spring seat 75. The partition wall 76 constitutes a bottom surface that is common to the recessed portion 72 and the recessed portion 74.

The recessed portion 72 of the receiving portion 73 is a portion in which the tip end portion 541 of the toner conveyance guide 54 is inserted when the toner container 3 is attached to the casing 11. As a result, the recessed portion 72 is formed in a shape that corresponds to the shape of the tip end portion 541. Specifically, as shown in FIG. 7, the upper part of the recessed portion 72 is formed in the shape of rectangle, and the lower part is formed in the shape of arc. In addition, an outer circumference portion of the upper part of the receiving portion 73 is formed in the shape of rectangle in correspondence with the inner wall surface of the large-diameter cylindrical portion 66, and an outer circumference portion of the lower part of the receiving portion 73 is formed in an approximate shape of arc. Furthermore, a recessed portion 77 whose shape in a cross section is circle is formed on a bottom surface of the recessed portion 72 (a surface of the partition wall 76 on the recessed portion 72 side) so as to be recessed in the thickness direction in the partition wall 76.

On the other hand, the recessed portion 74 is configured to support an end portion of the coil spring 68 provided in the interior space 621. As a result, the recessed portion 74 is formed in the shape of circle in a cross section in correspondence with the shape of the end portion of the coil spring 68.

The coil spring 68 is a so-called compression spring (a compression coil spring), and is stored in the interior space 621 in a state of being compressed between the shutter member 71 and the closing wall 626. The coil spring 68 is configured to set the shutter member 71 at the closing position by applying a biasing force toward the closing position, to the shutter member 71. One of opposite ends (the left end) of the coil spring 68 is supported by the recessed portion 74 of the shutter member 71, and the other of the opposite ends (the right end) of the coil spring 68 is supported by the closing wall 626. In addition, the small-diameter cylindrical portion 67 is provided in a part of the interior space 621 on the closing wall 626 side, and the small-diameter cylindrical portion 67 is formed to have an inner diameter that allows the coil spring 68 to be stored therein. One end of the coil spring 68 is supported by the recessed portion 74, and the other end is supported by the small-diameter cylindrical portion 67 and the closing wall 626. With this configuration, the coil spring 68 is stably supported in the interior space 621.

In the present embodiment, a stopper member 661 is provided on an inner surface of the large-diameter cylindrical portion 66 so that the shutter member 71 receiving a spring force from the coil spring 68 can stop at the closing position. In the state where the shutter member 71 is disposed at the closing position, the seal member 65 is compressed by receiving an upward pressing force from the shutter member 71. This enhances the close contact between the seal member 65 and the shutter member 71, thereby preventing toner leakage from the toner discharge port 617.

In addition, as shown in FIG. 6, a projection portion 662 is formed to project from the large-diameter cylindrical portion 66 to be more outside of the opening 625 than the peripheral edge of the toner discharge port 617, namely, to project leftward. The projection portion 662 is provided on a lower end portion of the large-diameter cylindrical portion 66 that corresponds to a lower end portion of the opening 625. More specifically, the projection portion 662 is provided on a portion of the large-diameter cylindrical portion 66 that corresponds to a lower-half portion of the opening 625 lower than the center of the opening 625. The projection portion 662 projects outward like a jaw from on a portion of the large-diameter cylindrical portion 66 that corresponds to the lower half of the opening 625. The projection portion 662 is configured to receive toner leaked from the toner discharge port 617 when the toner container 3 is attached to or detached from the casing 11.

Figure 8A:
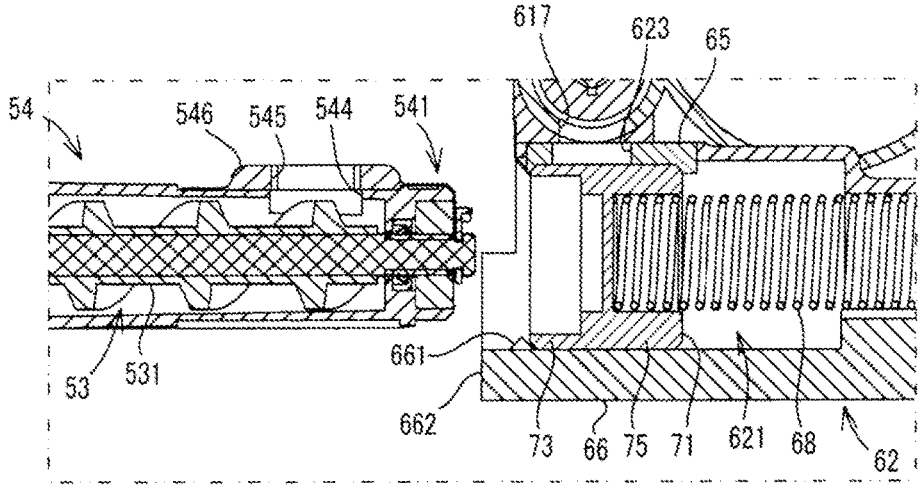
FIG. 8A, FIG. 8B, and FIG. 8C are partial cross-sectional views for explaining a movement of the shutter member of the toner container.
Figure 8B:
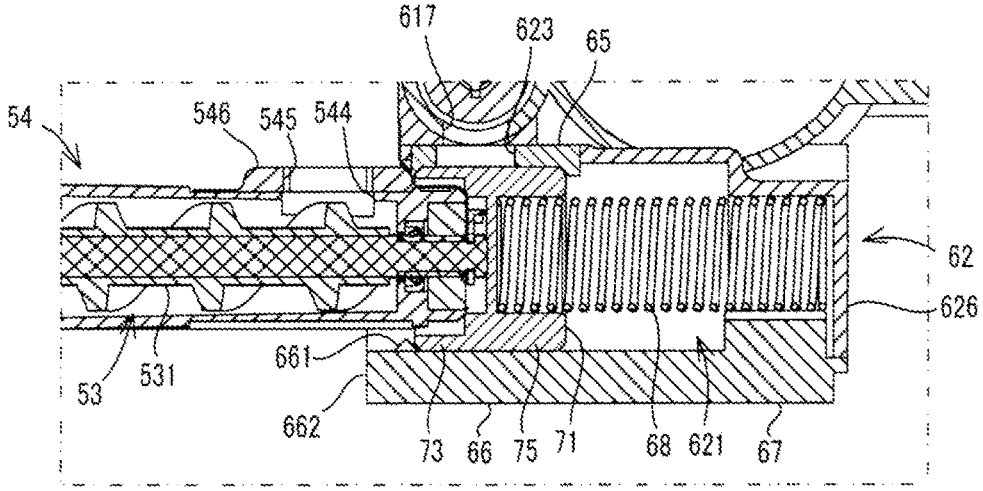
Figure 8C:
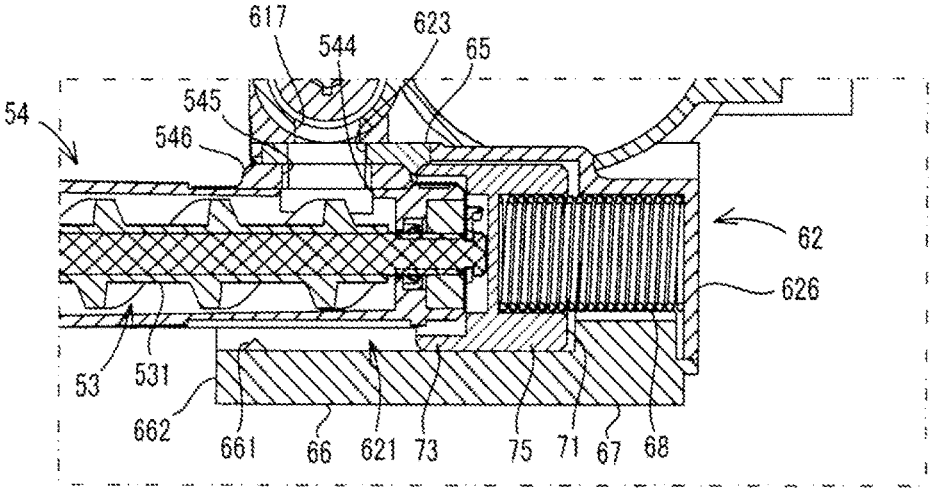

In the following, a description is given of the operation of the shutter member 71 when the toner container 3 is attached to the casing 11, with reference to FIG. 8A to FIG. 8C. Here, FIG. 8A shows a state before the tip end portion 541 of the toner conveyance guide 54 is inserted in the interior space 621 of the coupling portion 62. FIG. 8B shows a state where the tip end portion 541 abuts on the recessed portion 72 of the shutter member 71. FIG. 8C shows a state where the shutter member 71, pressed by the tip end portion 541, has moved from the closing position to the opening position.

The shutter member 71 is disposed at the closing position when the toner container 3 is not attached to the image forming apparatus 10. At this time, the toner discharge port 617 is closed in a state where the upper surface 711A (see FIG. 7) of the shutter member 71 is in close contact with the seal member 65. When the toner container 3 is supported by the support frame 11B during a process where the toner container 3 is attached to the casing 11, the opening 625 of the toner container 3 is positioned with the tip end portion 541 of the toner conveyance guide 54 so that the tip end portion 541 can be inserted in the opening 625 (see FIG. 8A).

When the toner container 3 is inserted in the casing 11 in the above-described state, the tip end portion 541 is inserted from the opening 625 into the interior space 621 of the coupling portion 62, and as shown in FIG. 8B, the tip end portion 541 enters the recessed portion 72 of the shutter member 71 that is at the closing position, and the outer peripheral edge of the tip end portion 541 abuts on the bottom surface of the recessed portion 72. At this time, an end portion of the rotation shaft 531 projecting from the tip end portion 541 enters the recessed portion 77 and abuts on the partition wall 76.

When the toner container 3 is further pressed toward the casing 11, the shutter member 71 receives the pressing force from the tip end portion 541 and moves from the closing position to the opening position resisting against the spring force of the coil spring 68. On the other hand, the toner conveyance guide 54 relatively moves in the interior space 621 to a position such that the replenishment port 544 is disposed below the toner discharge port 617. During the process where the shutter member 71 moves from the closing position to the opening position, the seal member 546 of the toner conveyance guide 54 and the seal member 65 of the coupling portion 62 relatively move along the depth direction D3 so as to approach each other while pressing each other, coming in close contact and contracting each other. Subsequently, as shown in FIG. 8C, when the shutter member 71 is disposed at the opening position, the seal member 546 is disposed below the seal member 65 of the coupling portion 62. At this time, the through hole 545 of the seal member 546 is positioned with the communication port 623 of the seal member 65, so that the seal member 65 is communicated with the toner discharge port 617. At this time, the seal member 65 and the seal member 546 that are both elastic are in close contact with each other. As a result, even if a vibration generated by an operation during image formation is transmitted to the toner container 3, toner leakage from the toner discharge port 617 is prevented since the seal member 65 and the seal member 546 are in close contact.

On the other hand, when the toner container 3 is detached from the casing 11, the shutter member 71 performs operations reversely to the above-described operations performed during the attachment. That is, during a process where the toner container 3 is removed horizontally from the support frame 11B, the tip end portion 541 of the toner conveyance guide 54 relatively moves in a direction of separating from the coupling portion 62 (leftward). With this movement, the pressing force that has been applied to the shutter member 71 from the tip end portion 541 is lost, and the shutter member 71 is moved from the opening position toward the closing position by the spring force of the coil spring 68. Subsequently, when the shutter member 71 reaches the closing position, the communication port 623 of the seal member 65 is closed by the shutter member 71, and the toner discharge port 617 is closed, too.

As described above, in the present embodiment, in a state where four outer wall surfaces 711 of the shutter member 71 are in sliding contact with all inner wall surfaces forming the interior of the large-diameter cylindrical portion 66, the shutter member 71 slides in the interior of the large-diameter cylindrical portion 66 between the closing position and the opening position. This allows the shutter member 71 to move smoothly without causing rattling between the shutter member 71 and the interior of the large-diameter cylindrical portion 66, enabling the shutter member 71 to be opened and closed smoothly. In addition, when the shutter member 71 is at the closing position, the upper surface 711A of the shutter member 71 is in close contact with the seal member 65, and when the shutter member 71 is at the opening position, the seal member 65 and the seal member 546 are in close contact with each other. This prevents toner from leaking from the toner discharge port 617 whether the shutter member 71 is at the closing position or the opening position.

Furthermore, even if toner leaks from the toner discharge port 617 during attachment or detachment of the toner container 3, the leaked toner is received by the projection portion 662 of the large-diameter cylindrical portion 66. As a result, even if toner leaks, the toner is prevented from dropping from the toner container 3 to outside.

It is noted that although in the above-described embodiment, the shutter member 71 is a block-like member that is formed in the shape of rectangle in a cross section, and the coupling portion 62 is formed in the shape of square tube, the shutter member 71 and the coupling portion 62 are not limited to such shapes. The shutter member 71 may have any shape as far as it is supported so as to be slidable in the interior space 621 in the depth direction D3 in a state where it is in sliding contact with the inner wall surfaces of the interior space 621 of the coupling portion 62.

In addition, in the above-described embodiment, the projection portion 662 is provided on a portion of the large-diameter cylindrical portion 66 that corresponds to a lower-half portion of the opening 625 lower than the center of the opening 625. However, the projection portion 662 may have any shape as far as it projects from a portion corresponding to a lower end portion of the opening 625 and can receive leaked toner.

In addition, in the above-described embodiment, the toner container 3 is described as an embodiment of the toner case of the present disclosure, and the image forming apparatus 10 is described as an embodiment of the image forming apparatus of the present disclosure. However, the present disclosure is applicable to a toner supply device which replenishes (supplies) toner from a downward toner discharge port 617 provided in the toner container 3 to the replenishment port 544 of the developing device 43. In this case, the toner supply device is composed of the coupling portion 62, the shutter member 71, and the coil spring 68 provided in the toner container 3, and the toner conveyance guide 54 provided in the developing device 43.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner case comprising:

a toner storage portion configured to store toner in an interior thereof and having a toner discharge port formed in a bottom surface thereof;

a tubular portion formed in a shape of a square tube which is rectangular in a cross section perpendicular to an extension direction of the tubular portion, the tubular portion having an interior space extending in a horizontal direction and communicated with the interior of the toner storage portion through the toner discharge port, an opening being formed at one of opposite ends of the interior space, a closing wall being formed at the other of the opposite ends of the interior space;

a shutter member provided in the interior space and supported so as to be slidable in the extension direction of the tubular portion, against inner wall surfaces of the tubular portion forming the interior space, the shutter member being movable between a closing position and an opening position, the shutter member at the closing position coming in close contact with a peripheral edge of the toner discharge port and closing the toner discharge port, the opening position being separated from the closing position toward the closing wall, the shutter member at the opening position opening the toner discharge port, the shutter member being a block member that is formed in a shape of a rectangle in a cross section in correspondence with a shape of the interior space of the tubular portion, the shutter member being supported in the interior space in a state where four outer wall surfaces of the shutter member are respectively in sliding contact with four inner wall surfaces forming the interior space and being elongated in the extension direction; and a biasing member provided in the interior space between the shutter member and the closing wall and configured to position the shutter member to the closing position by applying a biasing force to the shutter member.

2. The toner case according to claim 1, wherein the shutter member includes:

a first part having a first recessed portion formed on a side surface of the shutter member on a side of the opening;

a second part having a second recessed portion formed on a side surface of the shutter member on a side of the closing wall;

a partition wall dividing the first recessed portion from the second recessed portion and constituting a bottom surface that is common to the first recessed portion and the second recessed portion, and the biasing member is a compression coil spring, wherein one of opposite ends of the biasing member is supported by the second recessed portion, and the other of the opposite ends is supported by the closing wall.

3. The toner case according to claim 2, wherein an outer perimeter portion of a lower part of the first part is formed in a shape of arc, and an outer perimeter portion of the second part is formed in a shape of rectangle.

4. The toner case according to claim 1, wherein a lower end portion of the tubular portion corresponding to the lower end portion of the opening projects outward to be more outside of the opening than a peripheral edge of the toner discharge port.

5. The toner case according to claim 1, further comprising:

a conveyance member provided in the toner storage portion in such a way as to extend toward the toner discharge port, and configured to convey the toner in the toner storage portion toward the toner discharge port, wherein the extension direction of the tubular portion is perpendicular to an extension direction of the conveyance member.

6. A toner supply device configured to be coupled with a toner case having a downward toner discharge port such that toner is supplied from the toner discharge port to a developing device, the toner supply device comprising:

a tubular portion formed in a shape of a square tube which is rectangular in a cross section perpendicular to an extension direction of the tubular portion, the tubular portion being provided in the toner case and having an interior space extending in a horizontal direction and being communicated with the interior of the toner storage portion through the toner discharge port, an opening being formed at one of opposite ends of the interior space, a closing wall being formed at the other of the opposite ends of the interior space;

a shutter member provided in the interior space and supported so as to be slidable in the extension direction of the tubular portion, against inner wall surfaces of the tubular portion forming the interior space, the shutter member being movable between a closing position and an opening position, the shutter member at the closing position coming in close contact with a peripheral edge of the toner discharge port and closing the toner discharge port, the opening position being separated from the closing position toward the closing wall, the shutter member at the opening position opening the toner discharge port, the shutter member being a block member that is formed in a shape of a rectangle in a cross section in correspondence with a shape of the interior space of the tubular portion, the shutter member being supported in the interior space in a state where four outer wall surfaces of the shutter member are respectively in sliding contact with four inner wall surfaces forming the interior space and being elongated in the extension direction;

a biasing member provided in the interior space between the shutter member and the closing wall and configured to position the shutter member to the closing position by applying a biasing force to the shutter member; and a toner conveyance guide portion of a tubular shape provided in the developing device and projecting from a side wall of the developing device in the horizontal direction, a toner replenishment port being formed in an upper surface of a projection end portion of the toner conveyance guide portion, wherein when the toner case is coupled with the developing device so that the projection end portion of the toner conveyance guide portion is inserted in the opening, the shutter member receives a pressing force from the projection end portion and moves from the closing position to the opening position, and the toner conveyance guide portion relatively moves to a position such that the toner replenishment port is disposed below the toner discharge port.

7. An image forming apparatus comprising:

a developing device provided in an apparatus main body; and a toner case having a downward toner discharge port and configured to be coupled with the developing device such that toner is supplied from the toner discharge port to the developing device, wherein the toner case includes:

a toner storage portion configured to store the toner in an interior thereof and having the toner discharge port formed in a bottom surface thereof;

a tubular portion formed in a shape of a square tube which is rectangular in a cross section perpendicular to an extension direction of the tubular portion, the tubular portion having an interior space extending in a horizontal direction and communicated with the interior of the toner storage portion through the toner discharge port, an opening being formed at one of opposite ends of the interior space, a closing wall being formed at the other of the opposite ends of the interior space;

a shutter member provided in the interior space and supported so as to be slidable in the extension direction of the tubular portion, against inner wall surfaces of the tubular portion forming the interior space, the shutter member being movable between a closing position and an opening position, the shutter member at the closing position coming in close contact with a peripheral edge of the toner discharge port and closing the toner discharge port, the opening position being separated from the closing position toward the closing wall, the shutter member at the opening position opening the toner discharge port, the shutter member being a block member that is formed in a shape of a rectangle in a cross section in correspondence with a shape of the interior space of the tubular portion, the shutter member being supported in the interior space in a state where four outer wall surfaces of the shutter member are respectively in sliding contact with four inner wall surfaces forming the interior space and being elongated in the extension direction; and a biasing member provided in the interior space between the shutter member and the closing wall and configured to position the shutter member to the closing position by applying a biasing force to the shutter member, the developing device includes:

a toner conveyance guide portion of a tubular shape projecting from a side wall of the developing device in the horizontal direction, a toner replenishment port being formed in an upper surface of a projection end portion of the toner conveyance guide portion, wherein when the toner case is coupled with the developing device so that the projection end portion of the toner conveyance guide portion is inserted in the opening, the shutter member receives a pressing force from the projection end portion and moves from the closing position to the opening position, and the toner conveyance guide portion relatively moves to a position such that the toner replenishment port is disposed below the toner discharge port.

* * * * *